US009194350B2

(12) United States Patent
Shingu et al.

(10) Patent No.: US 9,194,350 B2
(45) Date of Patent: Nov. 24, 2015

(54) FUEL INJECTION VALVE AND METHOD OF MANUFACTURING THE SAME

(75) Inventors: Akio Shingu, Tokyo (JP); Keishi Nakano, Tokyo (JP); Tsuyoshi Munezane, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 807 days.

(21) Appl. No.: 13/439,926

(22) Filed: Apr. 5, 2012

(65) Prior Publication Data

US 2013/0074808 A1 Mar. 28, 2013

(30) Foreign Application Priority Data

Sep. 22, 2011 (JP) ..... 2011-206769

(51) Int. Cl.

*F02M 61/04* (2006.01)
*F02M 61/16* (2006.01)
*F02M 51/06* (2006.01)

(52) U.S. Cl.

CPC ..... *F02M 61/166* (2013.01); *F02M 51/0625* (2013.01); *F02M 51/0682* (2013.01); *F02M 61/168* (2013.01); *F02M 2200/903* (2013.01); *F02M 2200/9015* (2013.01); *F02M 2200/9023* (2013.01); *Y10T 29/49417* (2015.01)

(58) Field of Classification Search

CPC ..... F02M 51/0625; F02M 51/0632; F02M 51/0639; F02M 51/0642; F02M 51/0657; F02M 51/0667; F02M 51/0671; F02M 51/0682; F02M 61/168; F02M 61/1886

See application file for complete search history.

(56) References Cited

U.S. PATENT DOCUMENTS

| | | | | |
|---|---|---|---|---|
| 2006/0124771 | A1* | 6/2006 | Catasus-Servia | 239/533.12 |
| 2006/0214541 | A1* | 9/2006 | Tsuzuki et al. | 310/328 |
| 2009/0159728 | A1* | 6/2009 | Suzuki et al. | 239/584 |
| 2009/0179166 | A1* | 7/2009 | Reiter | 251/129.15 |
| 2009/0301442 | A1* | 12/2009 | Reiter | 123/490 |
| 2011/0073683 | A1* | 3/2011 | Hashii et al. | 239/548 |
| 2011/0284666 | A1* | 11/2011 | Sugiyama et al. | 239/533.2 |
| 2012/0204839 | A1* | 8/2012 | Ohwada et al. | 123/472 |

FOREIGN PATENT DOCUMENTS

| | | |
|---|---|---|
| JP | 2002-266720 | 9/2002 |
| JP | 2005-337207 | 8/2005 |
| JP | 2006-348815 | 2/2006 |
| JP | 2006-090277 A | 4/2006 |
| JP | 2008-057430 A | 3/2008 |
| JP | 2009-052470 A | 3/2009 |

OTHER PUBLICATIONS

Japanese Office Action issued Jan. 22, 2013, in Patent Application No. 2011-206769.

* cited by examiner

*Primary Examiner* — Erick Solis
(74) *Attorney, Agent, or Firm* — Sughrue Mion, PLLC

(57) ABSTRACT

A fuel injection valve includes a solenoid device which generates a magnetic sucking force; a core provided inside the solenoid device; a movable valve element composed of an armature coming into contact with the core, a pipe section whose one end is joined to the armature, and a valve section joined to the other end of the pipe section, the valve element being suctioned against a spring during energization of the solenoid device; and a valve seat unit having a valve seat to or from which the valve element is mounted or removed by the magnetic sucking force generated from the solenoid device and pressing force of the spring. The armature, the valve section, and the pipe section of the valve element are integrally configured by molding with resin, the armature and the valve section being joined by the pipe section.

12 Claims, 5 Drawing Sheets

FUEL INJECTION VALVE AND METHOD OF MANUFACTURING THE SAME

BACKGROUND OF THE INVENTION

1. Field of the Invention

The present invention relates to an electromagnetic fuel injection valve and a method of manufacturing the same, both of which are mainly used for a fuel supply system of an internal combustion engine.

2. Description of the Related Art

The configuration of this kind of a general fuel injection valve will be described in accordance with FIG. 5. As shown in FIG. 5, a fuel injection valve 1 has a solenoid device 2 disposed inside a resin molding portion 10, a core 3, and a housing 14 which constitutes a magnetic path, those of which are integrally formed.

Furthermore, a rod which adjusts a load of a spring 9 is fixed inside the core 3, and the core 3 and a holder 15 are fixed by welding to the housing 14 which constitutes the magnetic path.

Further, a movable valve element 7, a plate 11 having an injection hole part 11*a*, and a valve seat unit 8 which is mounted to or removed from the valve element 7 to form a valve mechanism are provided inside the holder 15; and the valve element 7 is composed of an armature 4, a valve section 6, and a pipe section 5 which joins the armature 4 and the valve section 6 at both ends of the pipe section 5. The armature 4 and the valve section 6 of the valve element 7 uses high hardness metal in consideration of abrasion durability and the whole of the valve element 7 is integrally manufactured by cutting.

Under such a configuration, usually, the valve element 7 is pressed to a valve seat 8*a* side of the valve seat unit 8 by a spring 9 and accordingly the fuel injection valve 1 is in a closed valve state. When the solenoid device 2 is energized, the armature 4 is suctioned to the core 3 side by a magnetic sucking force generated in the solenoid device 2 and the valve element 7 moves to the core 3 side; and accordingly, a gap is generated between the valve section 6 and the valve seat 8*a* of the valve seat unit 8 and the valve element 7 is in an opened valve state. As a result, fuel flows through the gap and the injection hole part 11*a*.

In such conventional fuel injection valve 1, the armature 4 and the valve section 6 of the valve element 7 are joined by welding or the like; and therefore, the pipe section 5 is made of metal. As a result, a mass of the valve element increases and when the valve is opened or closed, the armature 4 hits the core 3 and the valve section 6 hits the valve seat 8*a*; and accordingly, a noise is generated between the armature 4 and the core 3 and between the valve section 6 and the valve seat 8*a*.

As a technique of reducing such noise, one in which emission to the outside of a collision sound is reduced has been devised, for example, a soundproof effect is improved by improving the rigidity of peripheral components of the valve element 7 and the resin molding portion 10 is formed in a double-layered structure consisting of different materials (Patent Documents 1 and 2)

However, such technique has problems of a cost increase due to an increase in the number of components and man-hours and an increase in weight of the fuel injection valve 1.

Furthermore, a technique of absorbing collision energy and reducing the collision sound by placing a vibration proofing member on the periphery of the valve seat 8*a*, has been devised (Patent Document 3). Also this case has a problem of a cost increase due to an increase in the number of components and degradation in assembly property.

Further, in recent years, due to an improvement in spray targeting property, the distance from the mounting section 1*a* of the fuel injection valve 1 to the injection hole part 11*a* tends to increase so as to deeply enter the injection hole part 11*a* of the fuel injection valve 1 into the inside of an intake pipe or a cylinder head of an internal combustion engine. Therefore, a problem exists in that the pipe section 5 of the valve element 7 is long; and accordingly, the mass of the valve element 7 increases and the collision sound further increases.

REFERENCES

Patent Document 1: Japanese Laid-Open Patent Publication No. 2009-052470

Patent Document 2: Japanese Laid-Open Patent Publication No. 2008-057430

Patent Document 3: Japanese Laid-Open Patent Publication No. 2006-090277

In the above described conventional fuel injection valve 1 of the internal combustion engine, the armature 4 hits the core 3 and the valve section 6 hits the valve seat unit 8 at the time of opening or closing the valve; and accordingly, a high frequency collision sound is generated and thus quiet property during operation is diminished.

Furthermore, reduction in weight of the valve element 7 is desirable in order to reduce the collision sound; however, high hardness metal needs to be used for the armature 4 and the valve section 6 in consideration of abrasion; and there is also a limit to thin the pipe section 5 due to strength shortage and/or securement of coaxial accuracy after joining by welding.

The present invention has been made to solve the foregoing problem, and an object of the present invention is to achieve reduction in weight inexpensively while securing the strength and the coaxial accuracy of a valve element and to reduce a collision sound generated during operation of a fuel injection valve.

Furthermore, an object of the present invention is to obtain a method of accurately and efficiently manufacturing a fuel injection valve.

SURMMARY OF THE INVENTION

A fuel injection valve according to the present invention includes a movable valve element composed of an armature which comes into contact with a core in a solenoid device, a pipe section whose one end is joined to the armature, and a valve section which is joined to the other end of the pipe section and is mounted to or removed from a valve seat of a valve seat unit; and the pipe section is formed with resin.

Furthermore, in a method of manufacturing a fuel injection valve according to the present invention, an armature, a valve section, and a pipe section which joins the armature and the valve section, those of which constitute a movable valve element, are integrally manufactured by insert molding.

The fuel injection valve according to the present invention is constituted as described above; and therefore, reduction in weight of the pipe section can be achieved and quiet property of the fuel injection valve can be improved inexpensively without increasing man hours and the number of components.

Furthermore, by the method of integrally forming the valve element by insert molding, the armature, the resin pipe section, and the valve section can be simultaneously joined, manufacturing man-hours is reduced, and cost can be considerably reduced.

The foregoing and other object, features, and advantages of the present invention will become more apparent from the following detailed description of preferred embodiments and description shown in the accompanying drawings.

DETAILED DESCRIPTION OF THE INVENTION

Preferred Embodiment 1.

Hereinafter, a fuel injection valve according to a preferred embodiment 1 of the present invention will be described on the basis of drawings.

Figure 1:
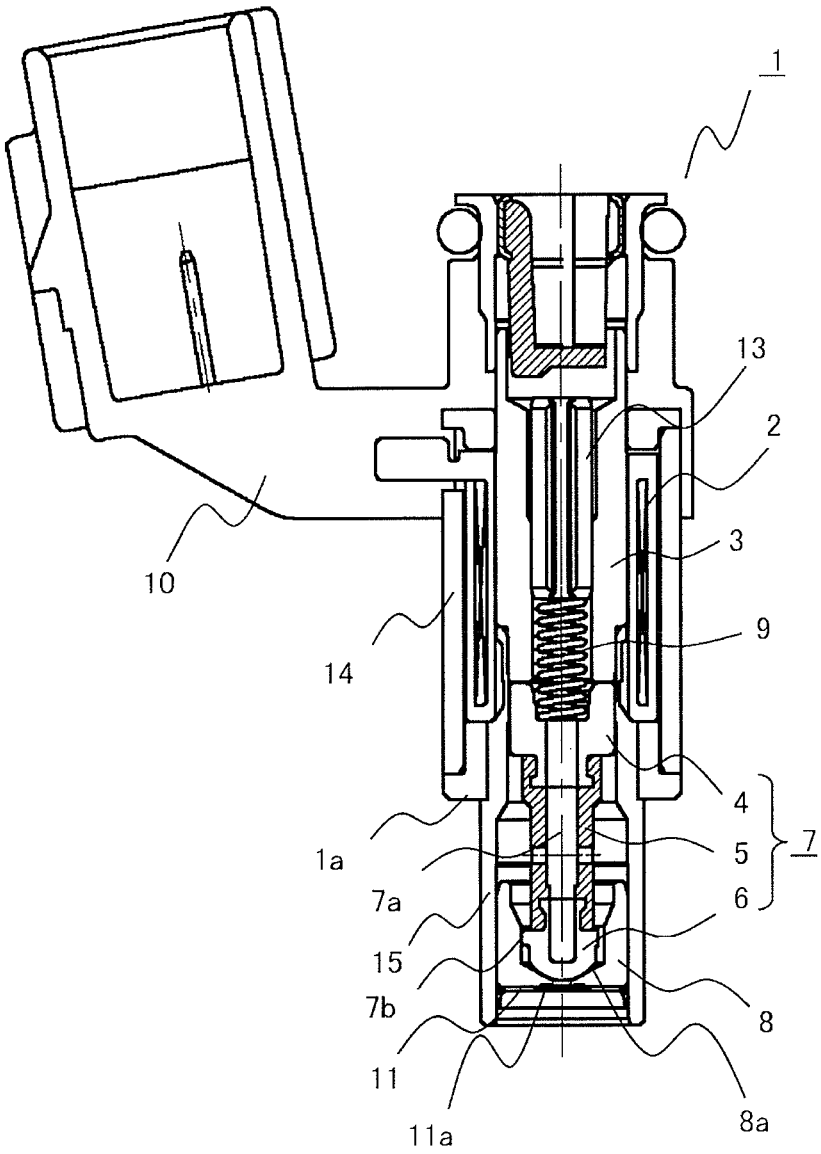
FIG. 1 is a sectional view showing a fuel injection valve according to a preferred embodiment 1 of the present invention.

FIG. 1 is a sectional view showing a fuel injection valve 1 according to the preferred embodiment 1 of the present invention. In FIG. 1, the fuel injection valve 1 has a solenoid device 2 disposed inside a resin molding portion 10, a core 3, and a housing 14 which constitutes a magnetic path, those of which are formed by integral molding. Furthermore, a rod 13 which adjusts a load of a spring 9 is fixed inside the core 3. Further, the core 3 is fixed to one end of the housing 14 by welding and a holder 15 is fixed to the other end by welding; and accordingly, a magnetic path is constituted as a whole.

Inside the holder 15, a valve element 7 which is composed of an armature 4, a pipe section 5, and a valve section 6 is disposed; a valve seat unit 8 having a valve seat 8*a* to or from which the valve section 6 is mounted or removed is placed; and a plate 11 having an injection hole part 11*a* is placed. The armature 4 is configured such that the armature 4 is pressed to the valve seat 8*a* side by the spring 9 and the armature 4 slides through the inside of the holder 15 by being suctioned by the solenoid device 2 during energization thereof. Furthermore, the valve section 6 joined to the armature 4 also slides along the inner diameter of the valve seat unit 8 disposed inside the holder 15, and the valve section 6 is disposed so as to be able to be mounted to or removed from the valve seat 8*a* of the valve seat unit 8. Incidentally, a guide section 7*b* formed by being protruded on the outer circumference of the valve section 6 is processed in a pentagon-shape; and the guide section 7*b* guides the valve element 7 along the inner circumferential surface of the valve seat unit 8 and forms a fuel path.

Furthermore, the fuel path having a cylindrical shape is formed in the valve seat unit 8; and the plate 11 formed with the injection hole part 11*a* is placed so as to face the fuel path.

In such fuel injection valve 1, in the case where the solenoid device 2 is not energized, the valve element 7 is pressed to the valve seat 8*a* by the spring 9 to stop the supply of fuel by blocking the injection hole part 11*a*. On the other hand, in the case where the solenoid device 2 is energized, the armature 4 is suctioned to the core 3 side against the spring 9 and the valve element 7 is moved to the core 3 side; and accordingly, a gap is generated between the valve section 6 and the valve seat 8*a* to be in an opened valve state. As a result, the fuel flows through the gap between the valve section 6 and the valve seat 8*a* and further flows through the injection hole part 11*a* of the plate 11.

In this case, the valve element 7 is formed by integrally joining the armature 4 and the valve section 6 by insert molding with the pipe section 5 which uses polyamide series resin containing not lower than 30% of glass fiber. In this way, the polyamide series resin containing not lower than 30% of glass fiber is used; and accordingly, the strength and corrosion resistance of the valve element 7 can be secured.

Furthermore, the pipe section 5 is made of resin; and accordingly, reduction in weight of the fuel injection valve 1 can be achieved and, further, quiet property of the fuel injection valve 1 can be improved inexpensively without increasing man hours and the number of components.

Next, a method of manufacturing such valve element 7 will be described using FIGS. 2A to 2C.

Figure 2:
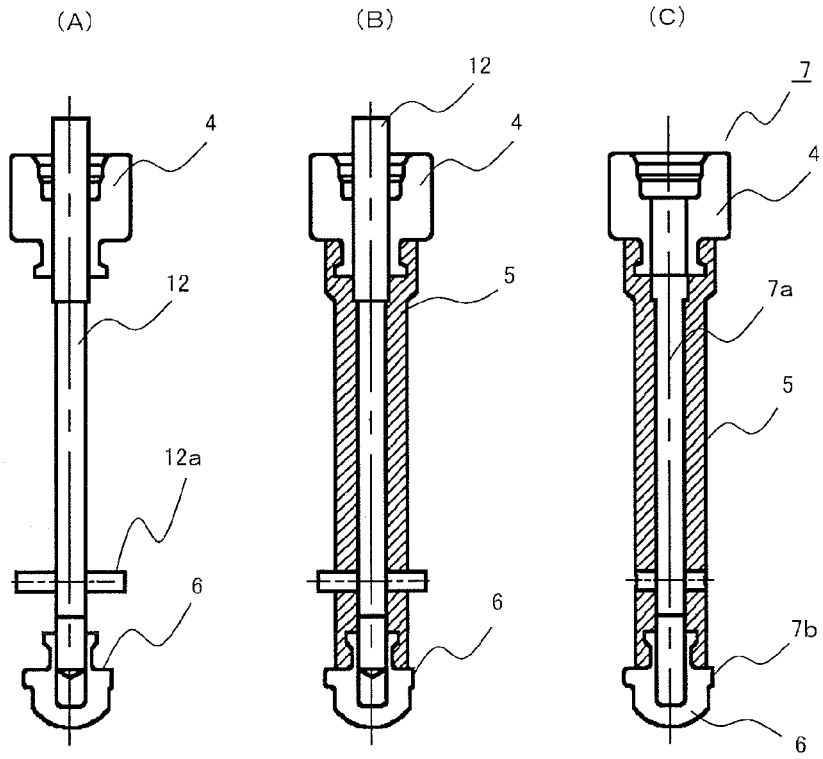
FIGS. 2A to 2C are sectional views for explaining a method of manufacturing a fuel injection valve of the preferred embodiment 1 of the present invention.

First, as shown in FIG. 2A, the armature 4 and the valve section 6 are fixed to an axial rod 12 and are arranged in a die (not shown in the drawing) after mounting a core cylinder 12*a*. Next, polyamide series resin containing not lower than 30% of glass fiber is injected in the die and insert molding is performed; and, as shown in FIG. 2B, the armature 4, the valve section 6, and the pipe section 5 are integrally molded.

After that, the axial rod 12 is extracted and the core cylinder 12*a* is removed; and, as shown in FIG. 2C, the valve element 7 formed in one body is made. In this way, coaxial accuracy of the armature 4 and the valve section 6 can be secured by using the axial rod 12, and an internal hollow part of the pipe section 5 formed by removing the axial rod 12 and the core cylinder 12*a* can be used as a fuel path 7*a*.

Finally, plate processing of metal such as chromium is performed on the outer circumferential surface of the guide section 7*b* which comes into contact with the valve seat unit 8 as needed, and the valve element 7 is completed.

In this way, the guide section 7*b* is plated; and accordingly, foreign particles due to the occurrence of axis deviation between the valve element 7 and the fuel injection valve 1 itself and abrasion powder can be prevented from entering into fuel, the axis deviation and the abrasion powder being generated by abrasion between the guide section 7*b* and the inner circumferential surface of the valve seat unit 8.

As described above, the armature 4 and the valve section 6 are manufactured by insert molding and accordingly the armature 4, the resin pipe section 5, and the valve section 6 can be simultaneously joined; and thus, man-hours can be reduced as compared to conventional welding joint and cost can be considerably reduced.

Furthermore, the insert molding is performed after fixing the armature 4 and the valve section 6 to the axial rod 12; and accordingly, coaxial accuracy of the armature 4 and the valve section 6 after the molding can be secured. In addition, the hollow part in the pipe section 5 serves as the fuel path 7*a*, the hollow part being formed in the case of extracting the axial rod 12; and accordingly, the number of processing steps which is for forming the fuel path can be reduced.

Further, the guide section 7*b* is formed at a part of the pipe section 5; and accordingly, processing for constituting the fuel path in the valve section 6 is not required and manufacturing man-hours of the valve element 7 can be reduced.

Incidentally, the core cylinder 12*a* is mounted on the axial rod 12 and the insert molding is performed and, after that, the core cylinder 12*a* is removed together with the axial rod 12; however, after the molding, a hole passing through the inner and outer circumference of the pipe section 5 may be formed.

Preferred Embodiment 2.

Figure 3:
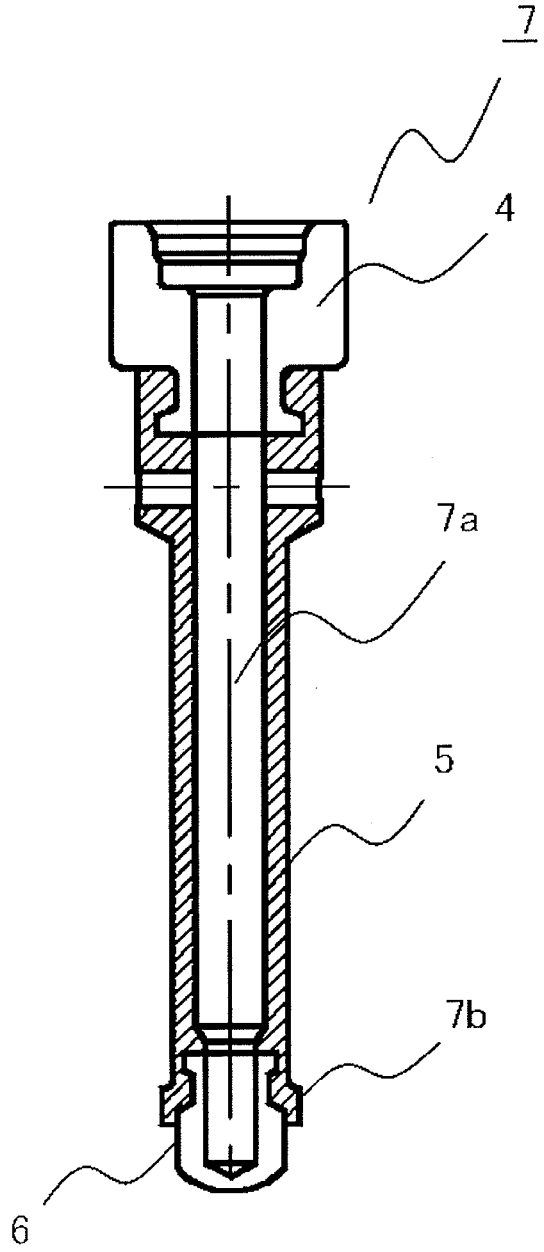
FIG. 3 is a sectional view showing a fuel injection valve according to a preferred embodiment 2 of the present invention.

FIG. 3 is a sectional view showing a valve element 7 according to a preferred embodiment 2 of the present invention. In FIG. 3, the lower outer diameter of a pipe section 5 made of polyamide series resin is formed to be protruded more largely than the outer diameter of a valve section 6 and the valve element 7 is formed by plating a guide section 7*b*; and the guide section 7*b* is made to slide along the inner circumferential surface of a valve seat unit 8. Also by such a configuration, abrasion resistance of the valve element 7 can be improved.

Preferred Embodiment 3.

Figure 4:
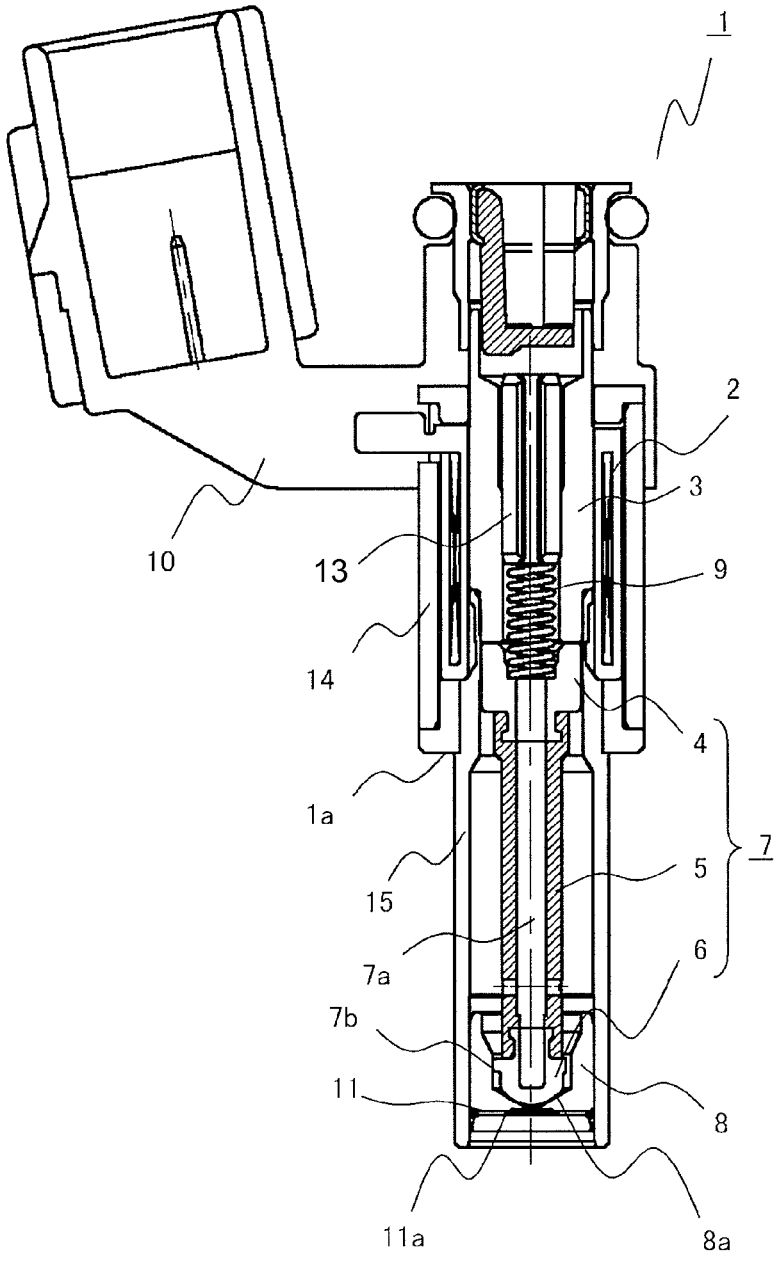
FIG. 4 is a sectional view showing a fuel injection valve according to a preferred embodiment 3 of the present invention.
Figure 5:
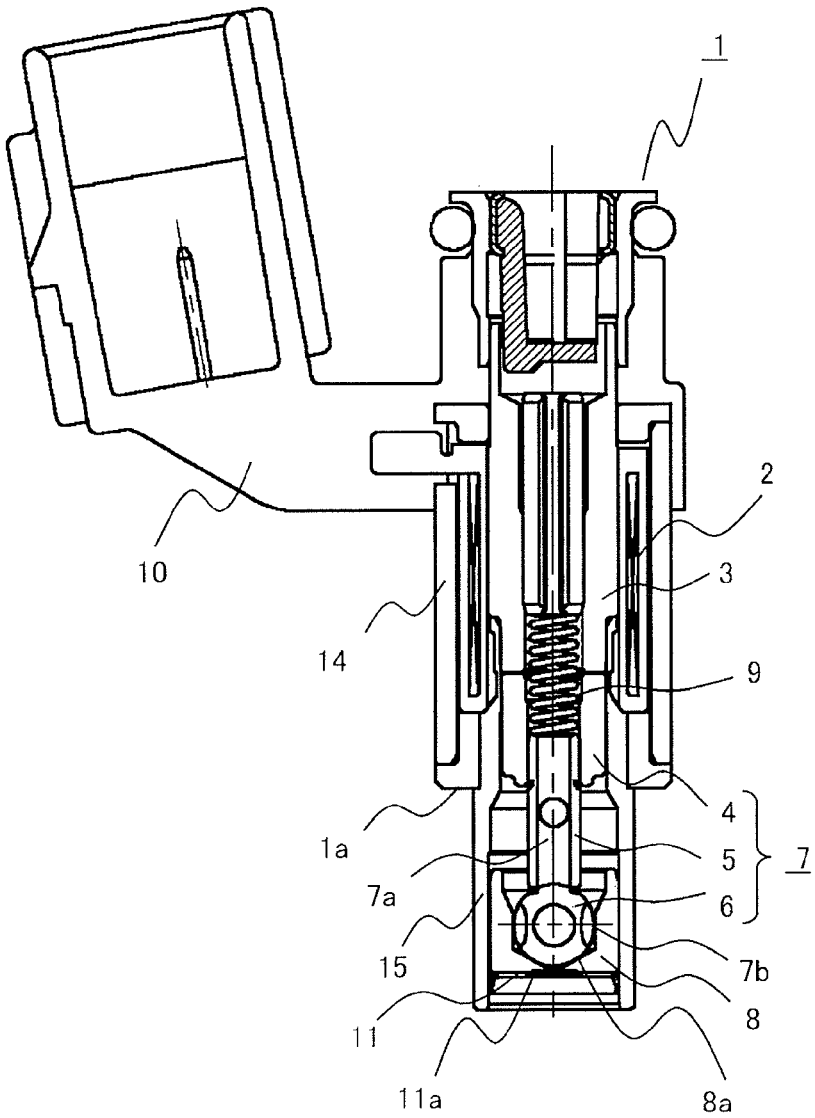
Fig. 5 PRIOR ART
FIG. 5 is a sectional view showing a conventional fuel injection valve.

FIG. 4 is a sectional view showing a fuel injection valve 1 according to a preferred embodiment 3 of the present invention. The embodiment of FIG. 4 shows an application example of the case where an injection hole part 11*a* of the fuel injection valve 1 needs to be configured so as to be entered more deeply into the inside of an intake pipe or a cylinder head of an internal combustion engine; and the example shows the case where the distance from a mounting section 1*a* of the fuel injection valve 1 to the injection hole part 11*a* is increased, that is, a pipe section 5 is prolonged.

In this case, the pipe section 5 is integrally formed with polyamide series resin containing not lower than 30% of glass fiber; and therefore, reduction in weight of a valve element 7 can be achieved and spray targeting flexibility can be expanded.

Incidentally, the present invention is not limited to the above-mentioned preferred embodiments, and the preferred embodiments can be appropriately changed or omitted in the scope of the present invention.

What is claimed is:

1. A fuel injection valve comprising:

a solenoid device which generates magnetic attraction;

a core which is provided inside said solenoid device;

a valve element which is pressed by a spring, and is suctioned against a pressing force of said spring during energization of said solenoid device to move to the core side; and a valve seat unit having a valve seat which is mounted or removed by the movement of said valve element to open or close a fuel path, wherein said valve element is composed of an armature which comes into contact with said core, a pipe section whose one end is joined to said armature, and a valve section which is joined to the other end of said pipe section; and said pipe section is formed with resin, wherein said armature and said valve section are integrally joined by insert molding of said pipe section.

2. The fuel injection valve according to claim 1, wherein the fuel path is formed inside said pipe section formed with resin.

3. The fuel injection valve according to claim 1, wherein said valve section is protruded on the outer circumference thereof to form a guide section which slides along the inner circumference of said valve seat unit.

4. The fuel injection valve according to claim 3, wherein the outer circumference of said guide section is plated.

5. The fuel injection valve according to claim 1, wherein said pipe section is protruded on the outer circumference thereof to form a guide section which slides along the inner circumference of said valve seat unit.

6. The fuel injection valve according to claim 5, wherein the outer circumference of said guide section is plated.

7. The fuel injection valve according to claim 1, wherein said pipe section uses resin which is polyamide series material containing not lower than 30% of glass fiber.

8. A method of manufacturing a fuel injection valve having a movable valve element, the method comprising the steps of:

fixing an armature and a valve section to an axial rod and disposing in a die;

injecting resin in the die and performing insert molding; and then extracting said axial rod, thereby forming said valve element.

9. The method of manufacturing the fuel injection valve according to claim 8, further comprising the steps of:

mounting a core cylinder which protrudes from the outer circumference of said axial rod and disposing in the die; and performing insert molding; and then removing said axial rod and said core cylinder, thereby forming said valve element.

10. A fuel injection valve comprising:

a solenoid device which generates magnetic attraction;

a core which is provided inside said solenoid device;

a valve element which is pressed by a spring, and is suctioned against a pressing force of said spring during energization of said solenoid device to move to the core side; and a valve seat unit having a valve seat which is mounted or removed by the movement of said valve element to open or close a fuel path, wherein said valve element is composed of an armature which comes into contact with said core, a pipe section whose one end is joined to said armature, and a valve section which is joined to the other end of said pipe section; and said pipe section is formed with resin, wherein said valve section is protruded on the outer circumference thereof to form a guide section which slides along the inner circumference of said valve seat unit, and wherein the outer circumference of said guide section is plated.

11. A fuel injection valve comprising:

a solenoid device which generates magnetic attraction;

a core which is provided inside said solenoid device;

a valve element which is pressed by a spring, and is suctioned against a pressing force of said spring during energization of said solenoid device to move to the core side; and a valve seat unit having a valve seat which is mounted or removed by the movement of said valve element to open or close a fuel path, wherein said valve element is composed of an armature which comes into contact with said core, a pipe section whose one end is joined to said armature, and a valve section which is joined to the other end of said pipe section; and said pipe section is formed with resin, and wherein said pipe section is protruded on the outer circumference thereof to form a guide section which slides along the inner circumference of said valve seat unit.

12. The fuel injection valve according to claim 11, wherein the outer circumference of said guide section is plated.

* * * * *